US008567104B1

(12) United States Patent
Donnelly

(10) Patent No.: US 8,567,104 B1
(45) Date of Patent: Oct. 29, 2013

(54) REMOVABLE FIRING PIN AND SAFETY FOR REVOLVERS

(75) Inventor: Douglas F. Donnelly, Hartford, CT (US)

(73) Assignee: United States Fire Arms Manufacturing Co., Ltd., Hartford, CT (US)

( * ) Notice: Subject to any disclaimer, the term of this patent is extended or adjusted under 35 U.S.C. 154(b) by 0 days.

(21) Appl. No.: 13/115,809

(22) Filed: May 25, 2011

Related U.S. Application Data

(60) Provisional application No. 61/348,176, filed on May 25, 2010.

(51) Int. Cl.
*F41A 17/00* (2006.01)

(52) U.S. Cl.
USPC ..... 42/66; 42/69.01; 42/70.08

(58) Field of Classification Search
USPC ..... 42/65–67, 69.01–69.03, 70.08
See application file for complete search history.

(56) References Cited

U.S. PATENT DOCUMENTS

| | | | | |
|---|---|---|---|---|
| 3,050,894 | A | 8/1962 | Ivy | |
| 4,385,463 | A | 5/1983 | Casull | |
| 4,581,836 | A | 4/1986 | Baker et al. | |
| 7,225,575 | B2 * | 6/2007 | Kiesel et al. | 42/70.08 |
| 8,006,609 | B2 * | 8/2011 | Kallio et al. | 89/196 |
| 8,132,496 | B2 * | 3/2012 | Zukowski | 89/142 |
| 8,156,677 | B2 * | 4/2012 | Glock | 42/71.02 |
| D661,766 | S * | 6/2012 | Siddle et al. | D22/103 |
| D661,767 | S * | 6/2012 | Siddle et al. | D22/103 |
| 8,276,302 | B2 * | 10/2012 | Zukowski | 42/70.01 |
| 8,296,990 | B2 * | 10/2012 | Zukowski et al. | 42/111 |
| 8,413,363 | B1 * | 4/2013 | Karfiol et al. | 42/106 |
| 2008/0104874 | A1 * | 5/2008 | Kiesel et al. | 42/70.08 |
| 2009/0071053 | A1 * | 3/2009 | Thomele et al. | 42/1.01 |
| 2012/0180354 | A1 * | 7/2012 | Sullivan et al. | 42/16 |
| 2013/0133236 | A1 * | 5/2013 | Merritt et al. | 42/70.01 |

OTHER PUBLICATIONS

Author Unknown, "Firing pin" web page printout dated Oct. 2, 2008 obtained from Wikipedia, the free encyclopedia, http://en.wikipedia.org/wiki/Firing_pin, 2 pgs.

* cited by examiner

*Primary Examiner* — Michael David
(74) *Attorney, Agent, or Firm* — Christie, Parker & Hale, LLP

(57) ABSTRACT

A hammer is adapted to receive a removable firing pin and includes an axial bore for receiving the firing pin and a transverse bore for receiving pins to secure the firing pin within the axial bore. The transverse bore includes a slave pin section for receiving a slave pin configured to mate with an annular groove or machined notch in the firing pin and a screw pin section for receiving a screw pin to secure the slave pin and the firing pin.

3 Claims, 4 Drawing Sheets

REMOVABLE FIRING PIN AND SAFETY FOR REVOLVERS

CROSS-REFERENCE TO RELATED APPLICATION(S)

This application claims the benefit of U.S. Provisional Patent Application No. 61/348,176, filed May 25, 2010, entitled "Removable Firing Pin and Safety For Revolvers," the entire contents of which are incorporated herein by reference.

BACKGROUND

In handguns, and specifically revolvers, a firing pin for striking a cartridge loaded into a chamber of the firearm is usually fixed or otherwise permanently installed in the hammer of the handgun. More specifically, the firing pin may be secured within an axial bore in the hammer by one or more transverse pins that are inserted into through-holes in the walls of the hammer and firing pin. The transverse pin is upset or otherwise distorted to secure the firing pin and the transverse pin itself within the hammer. Usually, once a transverse pin has been upset it is extremely difficult to remove not only the transverse pin, but also the firing pin from the hammer without damaging the relatively thin walls of the hammer at the axial bore. As such, if the firing pin is damaged or otherwise needs to be replaced, usually the entire hammer will need to be replaced, resulting in wastefulness and greater use of materials and higher manufacturing costs.

A removable firing pin would allow the firearm to be made safe for storage and transportation because the firearm is not able to be discharged without the firing pin. Further, a removable firing pin could be replaced by only another firing pin without needing to replace the entire hammer, and the firearm could also be cleaned more easily.

SUMMARY OF THE INVENTION

A hammer is adapted to receive a removable firing pin and includes an axial bore for receiving the firing pin and a transverse bore for receiving pins to secure the firing pin within the axial bore. The transverse bore includes a slave pin section for receiving a slave pin configured to mate with an annular groove or machined notch in the firing pin and a screw pin section for receiving a screw pin to secure the slave pin and the firing pin.

DETAILED DESCRIPTION OF THE INVENTION

Embodiments of the present invention are directed to a removable firing pin located in the hammer of a firearm. A firing pin may be damaged or distorted after repeated use and may need to be replaced for the firearm to operate properly and safely. Rather than replacing an entire hammer, merely replacing the firing pin without damaging the hammer may result in saving materials and manufacturing costs.

Figure 2:
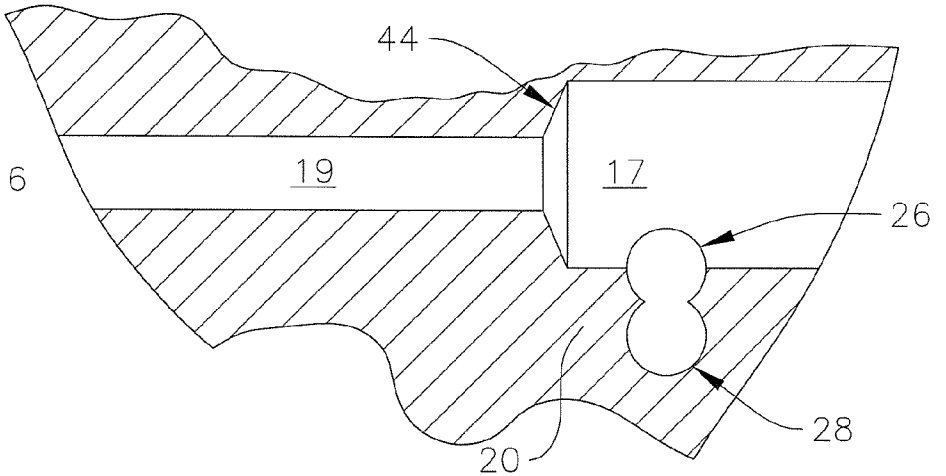
FIG. 2 is a detail cross-sectional view of an axial bore in the hammer of FIG. 1.
Figure 1:
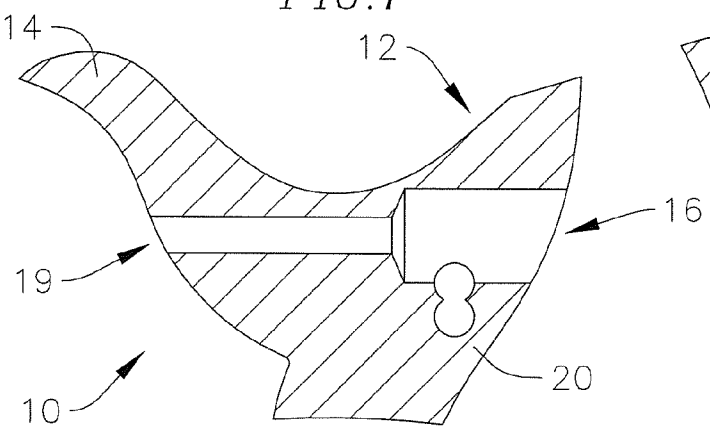
FIG. 1 is a cross-sectional side view of a hammer according to an embodiment of the present invention.

With reference now to FIG. 1, a hammer 10 for a firearm is provided having a body 12 and a spur 14. As will be appreciated, a user may use the spur 14 to cock the hammer before pulling the trigger of the firearm that releases the hammer, causing the hammer to rotate toward a loaded cartridge and thereby causing a firing pin 18 (FIG. 3) to strike the cartridge. The hammer 10 includes an axial bore 16 configured to receive and secure the firing pin 18 while allowing the firing pin to protrude from the body 12 of the hammer 10 such that the firing pin can contact a cartridge loaded into a cartridge cylinder of a firearm. With reference also to FIG. 2, the axial bore may include a larger diameter cylindrical firing pin section 17 for housing the firing pin 18 and a smaller diameter cylindrical firing pin removal section 19 through which a rod may be inserted to eject the firing pin 18 from the axial bore, and specifically from the firing pin section 17. The firing pin removal section 19 has a smaller diameter than the firing pin section 17, and thereby a step 44 is defined between the firing pin removal section and the firing pin section. As described in more detail below, the step 44 may be frusto-conically shaped to correspond to a beveled end 32 of the firing pin 18.

With reference to FIGS. 1 and 2, the hammer 10 further includes a transverse bore 20 having a generally "FIG. 8" configuration to accommodate a slave pin 22 (FIG. 4) and a screw pin 24 (FIG. 5), as described in more detail below. More specifically, the transverse bore 20 includes a slave bore section 26 configured to accommodate the slave pin 22 and to permit the slave pin to protrude into the axial bore 16, and a threaded screw bore section 28 configured to accommodate the screw pin 24, the screw bore section being adjacent the slave bore section. When the slave pin 22 and the screw pin 24 are inserted into the slave bore section 26 and screw bore section 28, respectively, the slave pin secures the firing pin 18 within the axial bore 16, as described in more detail below.

Figure 3:
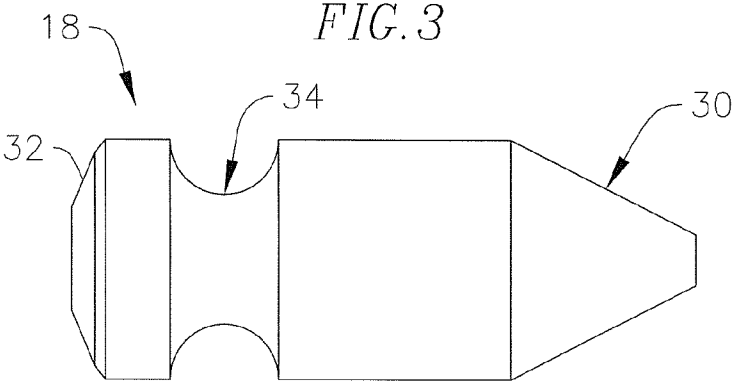
FIG. 3 is a side view of a removable firing pin according to an embodiment of the present invention.

With reference now to FIG. 3, the firing pin 18 includes a conical striking end 30 and a tapered or beveled end 32 opposite the striking end. The firing pin 18 includes an annular groove 34 extending around the circumference of the firing pin and configured for receiving the slave pin 22. Accordingly, a cross-sectional dimension of the annular groove 34 may substantially correspond to dimensions of the slave pin 22 to ensure a tight fit between the slave pin 22 and the firing pin 18.

Figure 5:
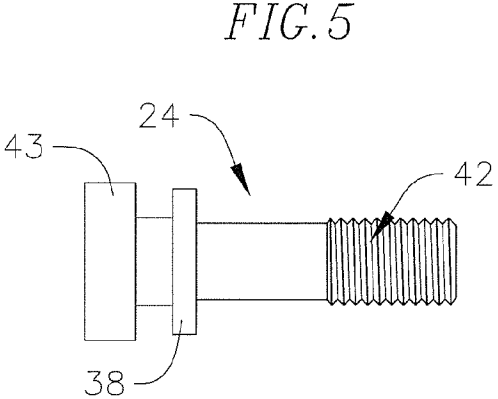
FIG. 5 is a side view of a screw pin according to an embodiment of the present invention.
Figure 4:
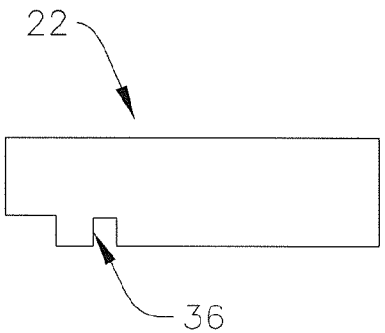
FIG. 4 is a side view of a slave pin according to an embodiment of the present invention.

With reference now to FIGS. 4 and 5, the slave pin 22 and the screw pin 24 are provided for insertion into the transverse bore 20 to secure the firing pin 18 in the axial bore 16. In one embodiment, the slave pin 22 is generally cylindrical and has a hemispherical or cylindrical slot 36 configured to receive a circumferential annular shoulder 38 of the screw pin 24. The screw pin 24 comprises a partially threaded body 42, a head 43 configured to receive a tool, such as a screw driver, for threading the screw pin into a threaded bore and a radial shoulder 38 extending from the body 42 for engaging the slot 36 of the slave pin. As will be appreciated, the slave pin 22 and the screw pin 24 can have a variety of mating configurations to achieve the same purpose.

Figure 7:
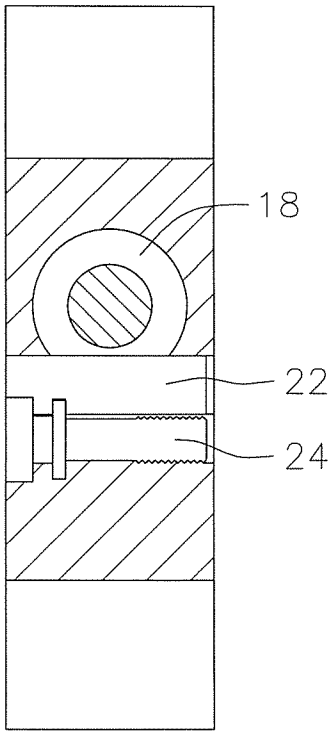
FIG. 7 is a schematic front cross-sectional view of the removable firing pin engaged within a hammer as shown in FIG. 6.
Figure 6:
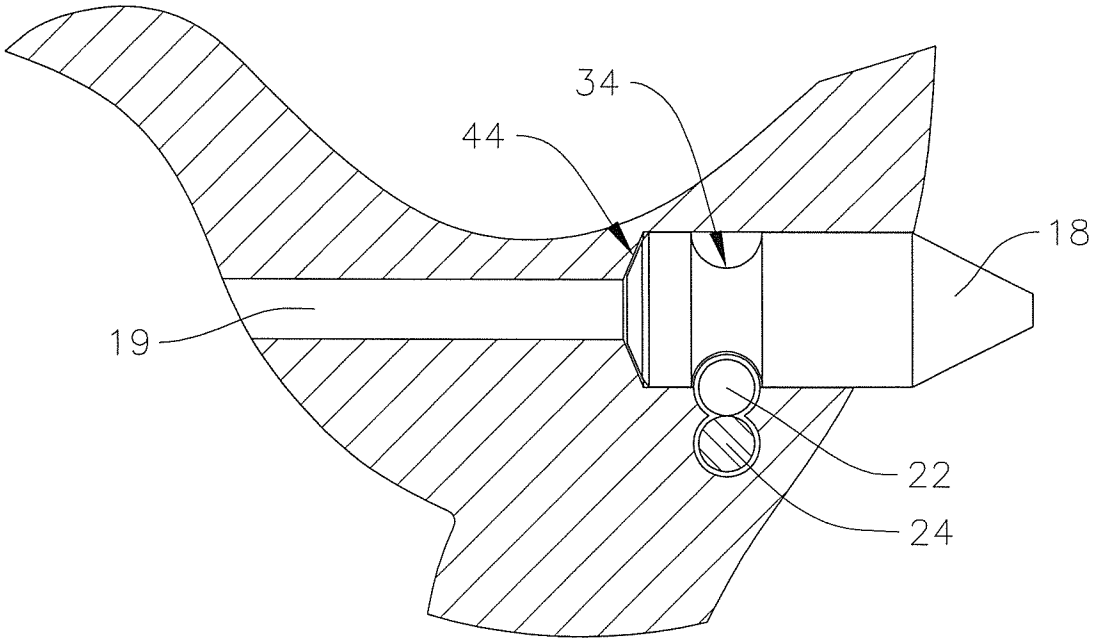
FIG. 6 is a schematic side partial-sectional view of a removable firing pin engaged within a hammer according to an embodiment of the present invention.

An insertion and removal procedure for the removable firing pin 18 will now be described with reference to FIGS. 6 and 7. The firing pin 18 may be inserted into the axial bore 16 such that the beveled end 32 abuts the step 44 and so that the groove 34 is generally aligned with the slave bore section 26 of the transverse bore 20. Once the firing pin 18 is within the axial bore 16, the shoulder 38 of the screw pin 24 is engaged with the slot 36 of the slave pin and the pin combination is inserted into the transverse bore such that the slave pin engages the groove 34 on the firing pin. The screw pin 24 can then be threaded into the screw bore section 28 to secure the slave pin 22 and screw pin in place. When the screw pin 24 has been threaded into the screw bore section 28 with the shoulder 38 engaged to the slot 36 of slave pin 22, the slave pin secures the firing pin 18 in the axial bore 16 of the hammer 10. The screw pin 24, slave pin 22 and firing pin 18 may be dimensioned such that the firing pin does not move relative to the hammer 10 to thereby repeatedly accurately strike a loaded cartridge and also so that neither the screw pin nor the slave pin protrude from the side of the hammer or otherwise interfere with the hammer's ability to smoothly rotate within the frame of the firearm.

If the firing pin 18 fractures or for other reasons needs to be removed from the hammer 10, the screw pin 24 can be unthreaded from the transverse bore 20, thereby allowing removal of the screw pin 24 and the slave pin 22 engaged to the screw pin. Once the pin combination is removed, the firing pin 18 can be removed from the axial bore 16 and replaced as necessary. As will be appreciated, the slave pin 22 and screw pin 24 may be reused if they are not damaged. Without a firing pin, a hammer of a revolver is not able to discharge a bullet in the chamber. Accordingly, a removable firing pin allows a user to remove the firing pin to prevent accidental firing of the gun, thereby increasing the safety of the firearm during, for example, shipping or storage of the firearm.

Figure 8:
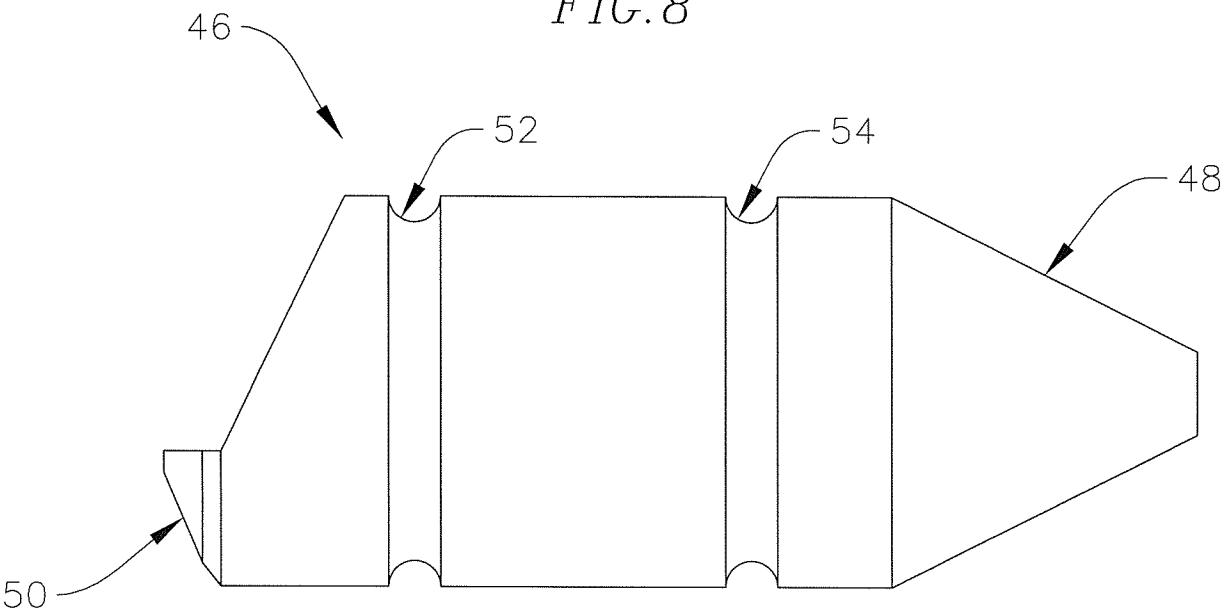
FIG. 8 is a side view of an alternate embodiment of a removable firing pin according to an embodiment of the present invention.

An alternate embodiment of a firing pin 46 is provided as shown in FIG. 8. The firing pin 46 is similar to the previously described firing pin 18, but it is a reversible firing pin usable with both "center firing" cartridges and "rim firing" cartridges, as are well-known in the art, and therefore has two striking ends 48, 50. The first striking end 48 is similarly conical like striking end 30 and has a striking tip at a center of the diameter of the firing pin 46 for use with "center firing" cartridges. The second striking end 50 is located off-center with respect to the diameter of the firing pin 46 for use with "rim firing" cartridges. The firing pin 46 has first and second annular grooves 52, 54 configured to receive a slave pin 22 as described above. More specifically, the annular grooves 52, 54 may be located along the firing pin 46 such that when the first annular groove 52 is aligned with the transverse bore 20, the first striking end 48 protrudes from the axial bore 16, and when the second annular groove 54 is aligned with the transverse bore 20, the second striking end 50 protrudes from the axial bore 16.

Figure 9:
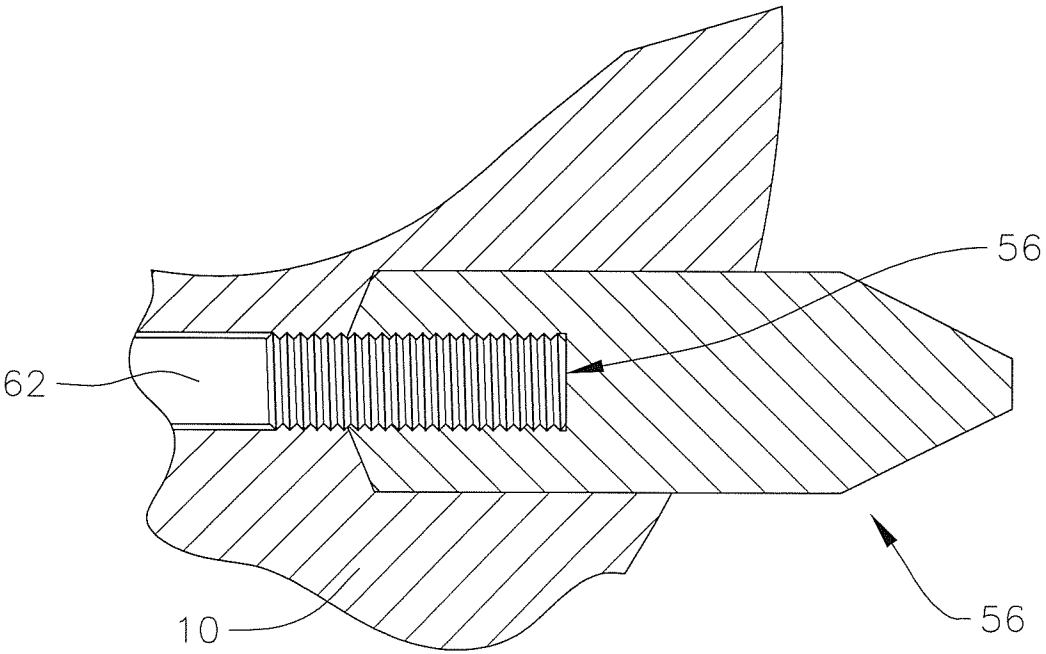
FIG. 9 is a detail cross-sectional side view of an alternate embodiment of a removable firing pin and a hammer according to an embodiment of the present invention.

FIG. 9 shows yet another alternate embodiment of a removable firing pin 56, substantially similar to the removable firing pin 18, but having a threaded bore 58 extending axially from a beveled end 60 rather than an annular groove. Further, a firing pin removal section 62 may be threaded for receiving a threaded fastener, such as a screw. When the firing pin 56 is inserted into the axial bore 16, a screw may be threaded into the firing pin removal section 62 and the threaded bore 58 to attach the firing pin 56 within the axial bore 16. As will be appreciated, since some hammers already have a firing pin removal section, an existing firing pin removal section can be threaded to accommodate an existing hammer for use with the removable firing pin 56.

While the present invention has been described in connection with certain embodiments, it will be understood that the invention is not limited to the disclosed embodiments, but on the contrary is intended to cover various modifications and equivalent arrangements included within the spirit and scope of the appended claims, and equivalents thereof.

What is claimed is:

1. A removable firing pin for a firearm comprising a first striking end comprising a conical striking tip protruding from a center of a diameter of the removable firing pin and a groove configured to mate with a pin to secure the firing pin within a firearm hammer, wherein the groove is a threaded groove within the removable firing in extending axially from a side opposite the first striking end.

2. The removable firing pin of claim 1, wherein the threaded groove is configured to receive a threaded fastener.

3. A hammer for a firearm comprising:

a body;

a first axial bore in the body configured to receive a firing pin, the firing in having a threaded groove within the firing pin;

a second axial bore intersecting the first axial bore, the second axial bore configured to receive a first threaded pin for securing the firing pin within the first axial bore.

* * * * *